United States Patent [19]

Carlsson

[11] 4,197,949

[45] Apr. 15, 1980

[54] OPENING OF CONTAINERS

[75] Inventor: Lars C. Carlsson, Blentarp, Sweden

[73] Assignee: Tetra Pak International AB, Lund, Sweden

[21] Appl. No.: 937,172

[22] Filed: Aug. 28, 1978

[30] Foreign Application Priority Data

Sep. 1, 1977 [GB] United Kingdom ..... 36642/77

[51] Int. Cl.[2] ..... B65D 5/54; B65D 5/72

[52] U.S. Cl. ..... 206/611; 206/625; 206/626; 206/628; 229/17 R

[58] Field of Search ..... 229/7 R, 17 R, 7 S, 229/176; 206/626, 610, 611, 628, 607, 625

[56] References Cited

U.S. PATENT DOCUMENTS

| | | | |
|---|---|---|---|
| 2,288,914 | 7/1942 | Monroe | 229/17 G |
| 2,750,093 | 6/1956 | Moore | 229/17 R |
| 2,801,040 | 7/1957 | Meyer-Jagenberg et al. | 229/7 R |
| 2,964,226 | 12/1960 | Nerenberg | 229/17 R |
| 3,353,738 | 11/1967 | Andreasson | 229/7 R |
| 3,613,986 | 10/1971 | Christensson | 229/17 R |
| 3,940,054 | 2/1976 | Goebel et al. | 229/7 R |
| 4,101,051 | 7/1978 | Reil | 229/7 R |
| 4,113,103 | 9/1978 | Carlsson | 206/630 |
| 4,126,263 | 11/1978 | Mortensson | 229/17 R |

FOREIGN PATENT DOCUMENTS

| | | |
|---|---|---|
| 2357431 | 3/1978 | France . |
| 1472157 | 5/1977 | United Kingdom . |

*Primary Examiner*—Stephen P. Garbe

*Attorney, Agent, or Firm*—Burns, Doane, Swecker & Mathis

[57] ABSTRACT

Containers made of flexible material often have opening arrangements in the form of a tear strip for opening an outlet aperture. The tear strip constitutes a part of the container wall and is limited by a weakening line. To facilitate initiation of the tear-open operation a short length of the weakened line has the form of a cut or cuts extending fully through the material. Two or more cuts may form a lug or projection, and if located at a fold line of the container blank the lug or projection may be arranged to automatically extend outwards from the finished container.

7 Claims, 5 Drawing Figures

OPENING OF CONTAINERS

This invention relates to the opening of packaging containers, and more especially containers formed from flexible laminate packaging material. It may be regarded as an improvement in, or modification of, the invention disclosed in the specification of British Patent Application No. 26540/77, where there is described a container having a tear-strip for opening an outlet aperture closed by an inner cover strip bonded over part of its area to the tear-strip.

The present invention consists of a container provided with a weakened line defining an area adapted to be torn open in order to provide an outlet aperture, said openable area being masked by an internal plastics seal, with said tear-open area being bonded to said internal plastics seal so that when the said area of the container is torn open it tears away with it only part of the corresponding area of the said plastics seal, and wherein a short length of said weakened line comprises a cut or cuts extending fully through the material forming the container, but not through the internal plastics seal by which the defined area is masked, in order to facilitate initiation of the tear-open operation.

The weakened line may conveniently be a line of perforations defining a strip of suitable shape in the packaging material forming the container, and since, with such a tear-strip it is not easy for a user to separate a short length of the edge of the tear-strip from the adjacent surrounding material in order to initiate opening of the container, the short length of the weakened line which is cut fully through, (but leaving the inner masking seal uncut, so that the contents remain fully sealed in the container) overcomes the difficulty. Two or more short cuts may provide a lug or projection from the edge of the tear-strip for ready grip to initiate opening of the container. This lug or projection may be located at a fold-line of the container blank, so that when the blank is folded into an erected container the lug or projection extends outwards from a fold of the blank.

BRIEF DESCRIPTION OF THE DRAWINGS

The invention will be clearly understood from the following description of one form which it may assume, and this description will be more readily understood by reference to the accompanying drawings wherein.

DETAILED DESCRIPTION OF THE INVENTION

In order to form the container of this invention, a blank of packaging material having an outer layer of paper or cardboard bonded to an inner layer of plastics material is provided, which is, of course, liquid-proof if the container is to hold liquid. The packaging material may, if desired, incorporate other laminate layers, e.g. an outer plastics layer and/or one or more additional inner layers of plastics or metal foil. The blank is preformed with crease-lines or fold-lines to facilitate folding into parallelepipedic shape when a container is being formed therefrom. The blank may be part of a web of packaging material adapted to be formed into a tube by seaming together opposite longitudinal edges, whereafter the tube is filled with the desired contents, e.g. milk, formed, by transverse sealing at spaced zones and by shaping, into a plurality of interconnected packaged containers which are separated by severance along the said sealing zones. Such a method of filling, forming, sealing and separating packages is fully disclosed in British Patent Specifications Nos. 1012867 and 1462956.

Figure 1:
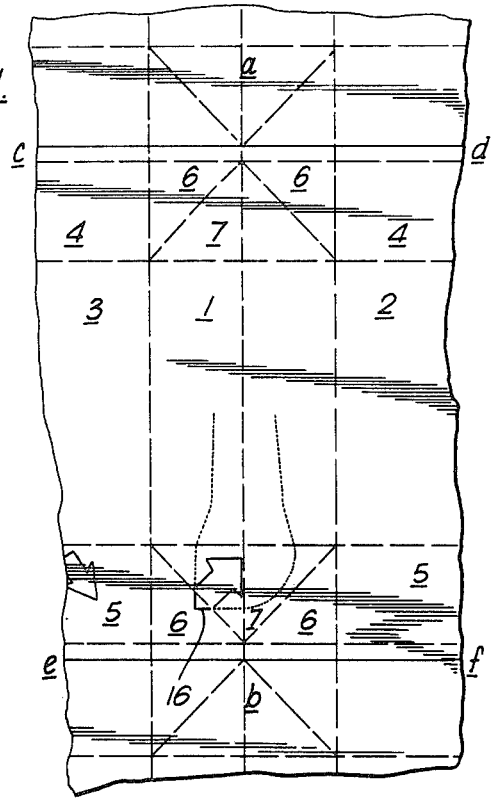
FIG. 1 represents part of a blank of packaging material from which a container in accordance with the invention may be formed.

FIG. 1 depicts an outside view of that part of a web of packaging material which will become the upper end of a package made in accordance with the aforesaid procedure. When the web is folded about the line a b the opposite areas and edges of the web (cut-off from the view shown in FIG. 1) are brought together, and the opposite edges sealed together in overlapping relationship, so that the web can thus be formed into a tube which is loaded with the desired contents e.g. milk. It will be noted that when the web is folded about the line a b transverse strips a c and a d come together at their inner faces, and after the tube is loaded an individual package is defined by heat-sealing together the internal surfaces of these strips c a d, and e b f. The packages are separated by severance along the sealing zones. The container can be formed into parallelepipedic shape by suitable relative folding of the panels defined by the fold-lines or crease-lines of the blank. The figures depict an end panel 1, a front-wall panel 2 and rear-wall panel 3, and opposite side wall panels 4, 5 each formed with a sealing fin folded flat against the panel. It will be noted that when the half-panels 4 or 5 forming the side-walls of the container are folded down and into the position shown in FIGS. 2 and 3, the right-angled triangular portions 6 of the panels at the ends of the top panel 1 fold under the middle isosceles-triangular portion 7 of the same panel to form outwardly projecting triangular lugs (FIG. 2) which, in the finished package, are folded down against and bonded to the side-walls 4 (FIG. 3).

Figure 5:
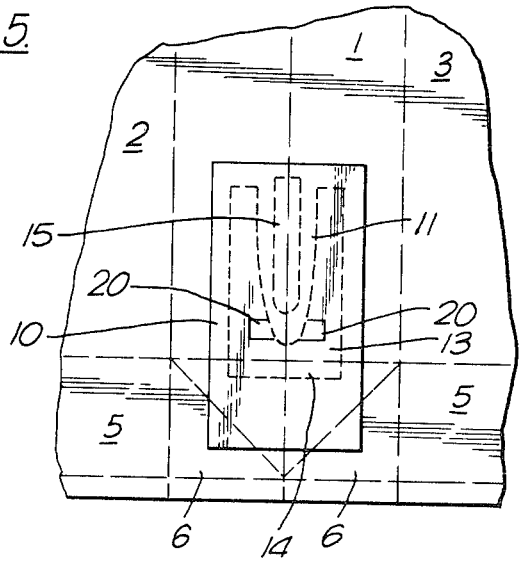
FIG. 5 presents an inside-surface view of part of the blank shown in FIG. 1.

To facilitate the opening of a filled package, such as described, there is provided a tear-strip adapted, upon finger-manipulation, to open an outlet aperture. This tear-strip is defined by a weakening line, e.g. a line of perforations in the top panel of the package. This line may comprise two substantially parallel leg portions 8 in the top panel 1 running to a loop 9 in the portion 7 of the triangular lug. The perforations may penetrate the panel 1, and also the layers of the triangular lug and the side-wall 5 to which it is bonded so that when the loop portion of the tear-strip is raised from its surroundings, and pulled upwards to tear open the strip along the perforation lines 8, a substantial aperture in the wall of the package is opened. To prevent escape of the contents of the package through this large aperture a masking seal 10 of plastics material is bonded to the inner surface of the container over and around the aperture (FIG. 5). In order to ensure that an outlet aperture for the contents of the package will be formed when the time strip is lifted, the inner surface of the tear-strip is bonded to the masking seal 10 over a selected area between the legs 8 of the lines of perforations. This area is preferably a tongue-shaped area 11 (FIG. 5). All other inside areas of the tear-strip are kept free from bonding (e.g. by an inhibiting agent) to the masking seal 10. In consequence, as will be seen from FIG. 5, when the tear-strip is released and lifted it tears away the tongue-shaped portion 11 of the seal 10 between the lines 8, but leaves other areas of the seal 10 unruptured so that the package then has an outlet aperture 12 for its contents.

The tongue-shaped area of the aperture may be defined by a U-shaped strip 13 of plastics material bonded to the masking seal 10 between the lines 8 of perforations. A lip portion 14 at the outer end of this strip 13 projects freely beyond the edge of the package when the tear-strip is raised, and the strip 13 with the projecting lip 14 provides a non-contaminated flow surface for contents of the package when first being poured from the aperture 12. A stiffening or reinforcing strip 15 of plastics material may be affixed between the tear-strip and the tongue-shaped area of the masking seal 10 to which the tear-strip is attached.

Some difficulty may arise when a user attempts, e.g. by fingernail, to separate the loop portion of the tear-strip from its surroundings when starting to open a package. In order to reduce this difficulty a short length of the line 9 of perforations is cut through the packaging material. Preferably this cutting is such as to define a lug or projection at the edge of the loop area of the tear-strip. In the form of tear-strip illustrated in the drawings the loop line 9 incorporates two short cuts substantially at right angles to one another to form a triangular lug 16 projecting from the loop portion of the tear-strip. As seen in FIG. 1 these cuts preferably stretch across or extend beyond a fold-line between panel portions 6 and 7, so that when those panel portions are folded together the projection 16 projects from the edge of the triangular lug of the package (FIG. 3) for ready access. A user can thus lift the projection 16, e.g. by finger nail, for gripping to tear open the loop portion, and subsequently the inner length of the tear-strip in order to expose the aperture 12 by tearing out the tongue-shaped area 11 of the masking seal 10, and pour out the contents of the package from the aperture 12 over the substantially aseptic surface 13, 14. A marking such as an arrow 17 incorporating the projection 16 and/or a marking, such as an arrow 18, on the package wall, may be provided to direct a user's attention to the mode of opening the package.

It should be understood that modifications may be effected in a package such as described herein without departing from the scope of the invention. Thus, for example, the shape of the tear-strip and/or the shape of the projections 16 and/or of the aperture 12 may be varied, as desired, as well as the shape and dimensions of the container in which they are incorporated.

Figure 4:
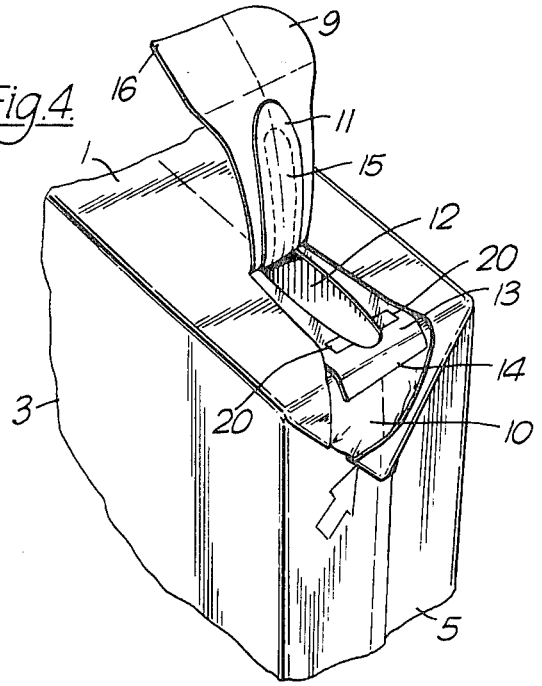
FIG. 4 represents in perspective the container shown in FIG. 3 after the outlet aperture has been exposed.

When the tear-strip is raised the liquid contents of the package (which is fully loaded and has no air inside) tend to sometimes squirt out during initial opening of the aperture 12. It has been found that this may be avoided by providing one or more small areas of the reinforcing plastics strip 13 adjacent to the first-torn end of the aperture 12 which are not bonded or otherwise attached to the masking seal 10. In a modification of the invention embodying this feature two small areas identified by rectangles 20 (FIGS. 4 & 5) of the reinforcement 13 are left free from attachment to the underlying areas of the masking seal 10.

It will be noted that the sides of the tear-strip diverge slightly from the inner folding end of the strip, and this provides a jamming effect (when the strip is folded down again after having been opened) tending to hold the strip re-closed. If further reclosure holding is desired the inner surface of the loop portion 9 of the tear-strip may be provided with a mid-area of pressure sensitive adhesive adapted to be pressed against the masking seal 10 when the strip is reclosed in order to hold it firmly in position.

If desired, finger-nail access to the edge of the loop 9 of the tear-strip may be facilitated by removing a crescent shaped strip of the adjacent container wall (but leaving the masking seal intact) along a short selected length of the weakened line. This may be alternative to, or in addition to, provision of the lug 16.

Figure 2:
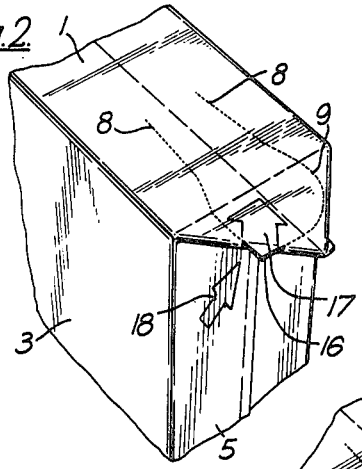
FIGS. 2 and 3 represent in perspective part of a container formed from a blank such as shown in FIG. 1.
Figure 3:
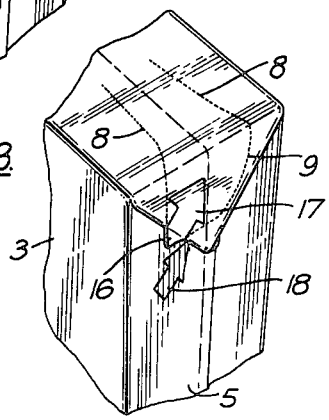

Parallelepipedic containers are known in which the sealing fins, instead of extending down the sides of the container (as shown in FIGS. 2 & 3) extend across the ends of the container between the tips of the triangular side flaps. When the present invention is applied to this form of container the tear-strip between the perforation lines 8 is located at one side of the center-line of the top surface of the container so as not to interfere with the folded-down fin, and the loop portion 9 of the tear-open flap may be of smaller dimension and/or of different shape, for the same reason.

What I claim is:

1. A container having first and second adjacent walls, said first wall including an opening arrangement comprising a line of perforations defining a tear strip which may be lifted to provide an opening in said first wall, a masking seal sheet attached to the inside of said first wall fully covering said opening, said sheet being bonded to the inside of a smaller area of the tear strip to tear an aperture corresponding to said area upon lifting said tear strip, said first and second walls cooperating to form a lug which lies adjacent said second wall and is connected to said first wall by a first fold line and to said second wall by a second fold line and is further defined by additional intersecting fold lines, said tear strip extending across said first fold line, said lug, and one of said intersecting fold lines, the portion of said tear strip which extends across said one intersecting fold line being bounded by a continuous cut extending from said one intersecting fold line in a loop to form a projection which extends outwardly from said one intersecting fold line, whereby said projection assists in the lifting of said tear strip to form the aperture for removing the contents from said container.

2. The container of claim 1 wherein said projection is substantially triangular in shape.

3. The container of claim 1 wherein said line of perforations includes parallel portions terminating in spaced relation to each other to form a hinge for said tear strip.

4. The container of claim 1 wherein said lug is substantially triangular in shape.

5. The container of claim 1 including a strip of plastic material between said first wall and said seal sheet, said plastic strip extending within said line of perforations and within said lug, whereby said plastic strip forms a pouring lip when said tear strip is lifted from the container.

6. The container of claim 5 wherein at least a portion of said strip of plastic material is bonded to said seal sheet.

7. The container of claim 6 wherein at least a portion of said plastic strip adjacent to and intersecting the first-torn end of said aperture is not bonded to said seal sheet to prevent the contents of said container from squirting when first opened.

* * * * *